US011655811B2

(12) United States Patent
Hines

(10) Patent No.: US 11,655,811 B2
(45) Date of Patent: May 23, 2023

(54) METHOD AND APPARATUS FOR MOUNTING A DIAPHRAGM OF A PUMP

(71) Applicant: Graco Minnesota Inc., Minneapolis, MN (US)

(72) Inventor: Bradley H. Hines, Andover, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 17/733,390

(22) Filed: Apr. 29, 2022

(65) Prior Publication Data

US 2022/0372969 A1 Nov. 24, 2022

Related U.S. Application Data

(60) Provisional application No. 63/190,645, filed on May 19, 2021.

(51) Int. Cl.
*F04B 53/22* (2006.01)
*F04B 43/02* (2006.01)

(52) U.S. Cl.
CPC ..... *F04B 53/22* (2013.01); *F04B 43/02* (2013.01)

(58) Field of Classification Search
CPC ..... F04B 53/22; F04B 43/02; F04B 43/0054; F04B 43/073; F04B 43/0736; F04B 43/026
See application file for complete search history.

(56) References Cited

U.S. PATENT DOCUMENTS

| | | | | |
|---|---|---|---|---|
| 3,784,772 | A * | 1/1974 | Nelson | H01H 35/34 200/83 B |
| 8,887,620 | B2 | 11/2014 | Macdonald et al. | |
| 9,845,794 | B2 | 12/2017 | Seith et al. | |
| 2006/0032037 | A1 | 2/2006 | Lo et al. | |
| 2011/0311378 | A1* | 12/2011 | MacDonald | F04B 43/0736 29/281.5 |

FOREIGN PATENT DOCUMENTS

| | | | |
|---|---|---|---|
| CA | 1172904 | A | 8/1984 |
| CN | 101913074 | A | 12/2010 |
| EP | 0999051 | A2 | 5/2000 |

OTHER PUBLICATIONS

Extended European Search Report for EP Application No. 22173897.4, dated Oct. 28, 2022, pp. 9.

* cited by examiner

*Primary Examiner* — Lee A Holly
(74) *Attorney, Agent, or Firm* — Kinney & Lange, P.A.

(57) ABSTRACT

A double diaphragm pump includes multiple diaphragms that are mounted for reciprocation. The diaphragms are connected for simultaneous movement to form a diaphragm assembly. A first one of the diaphragms is clamped between a housing cover and a center section. A pumping chamber is formed between the first diaphragm and the cover. Pressure in the first pumping chamber is decreased to draw the diaphragm assembly towards the first fluid cover, thereby drawing the second diaphragm into a mounting position relative to the center section. A second cover is then mounted to the center section to clamp the second diaphragm between the second cover and the center section.

13 Claims, 7 Drawing Sheets

METHOD AND APPARATUS FOR MOUNTING A DIAPHRAGM OF A PUMP

CROSS-REFERENCE TO RELATED APPLICATION(S)

This application claims priority to U.S. Provisional Application No. 63/190,645 filed May 19, 2021, and entitled "METHOD AND APPARATUS FOR MOUNTING A DIAPHRAGM OF A PUMP" the disclosure of which is hereby incorporated by reference in its entirety.

BACKGROUND

The present disclosure relates generally to the assembly of pumps. More specifically, this disclosure relates to seating and sealing diaphragms of a double diaphragm pump.

In a double diaphragm pump, in which the diaphragms are directly or indirectly mechanically linked to flex and pump out of phase, one diaphragm will be in the pumping stroke and the other will be in the suction stroke. If the drive is unpowered, such as when not receiving pressurized driving air, then the diaphragms will equalize, causing the drive to sit in a centered position in which both diaphragms are slightly flexed. The diaphragm naturally wants to assume a non-flexed state, but an un-flexed diaphragm can be hard to seal against the diaphragm mount. In some cases, the diaphragm pump cannot be powered (e.g., pneumatically) to move the diaphragms to the appropriate positions for mounting and sealing because the diaphragms are not both sealed. In some examples, a blocker plate can be installed to direct the incoming air to only a drive chamber associated with the sealed diaphragm. Such a configuration requires at least partial disassembly of the pump to mount the plate for diaphragm mounting and then again to dismount the plate for pump operation. The diaphragm can also be mounted by physically forcing the second diaphragm into position, such as by large C-clamps. Such a mounting process is physically demanding and time intensive.

SUMMARY

According to an aspect of the present disclosure, a method of mounting diaphragms to a pump includes reducing a pressure in a first pumping chamber defined by a first diaphragm and a first cover, the first cover mounted to a center section of the pump such that the first diaphragm is clamped between the first cover and the center section; drawing the first diaphragm in a first direction into the first pumping chamber by the reduced pressure to draw a second diaphragm linked to the first diaphragm in the first direction and place the second diaphragm in a mounting position relative to the center section; and mounting a second cover to the center section such that the second diaphragm is clamped between the second cover and the center section.

According to an additional or alternative aspect of the present disclosure, a method of mounting diaphragms of a pump includes mounting a first diaphragm on the pump; mounting a first cover to a center section of the pump to form a first chamber with the first diaphragm and the first cover; developing a partial vacuum within the first chamber, development of the partial vacuum moving a connector by the first diaphragm to move a second diaphragm to engage the second diaphragm with a receiver of the pump; and mounting a second cover to the receiver to secure the second diaphragm to the pump.

According to another additional or alternative aspect of the present disclosure, an apparatus for mounting a diaphragm of a pump includes a first cap configured to seal with a first neck of a housing cover of the pump; a second cap configured to seal with a second neck of the housing cover of the pump; and a fitting supported by the first cap, the fitting configured to allow airflow through the first cap.

DETAILED DESCRIPTION

This disclosure concerns double diaphragm pumps. In particular, this disclosure concerns a system and method for seating and sealing a diaphragm on a double diaphragm pump. In double diaphragm pumps, the diaphragms are directly or indirectly mechanically linked to flex and pump out of phase, such that one diaphragm will be in the pumping stroke and the other will be in the suction stroke. A first one of the diaphragms can be positioned with its sealing bead in a groove associated with a center section of the pump and a cover is mounted to clamp the bead between the cover and center section. Positioning the first diaphragm causes the mechanically linked second diaphragm to shift axially outward away from the center section due to the first diaphragm being in a resting, unflexed state. The mounted diaphragm naturally wants to assume a non-flexed state, biasing the second diaphragm axially outward. To seat the second diaphragm, the pressure is reduced in the sealed pumping chamber formed by the first diaphragm and the first cover, such as by applying a vacuum generator to that chamber. The reduction in pressure draws the first diaphragm axially into the pumping chamber. Drawing the first diaphragm into the pumping chamber also draws the second diaphragm toward the center section because of the mechanical linkage between the two diaphragms. The bead of the second diaphragm seats in a groove on the center section and a second cover can be secured to the center section to sealingly mount the second diaphragm.

Figure 1A:
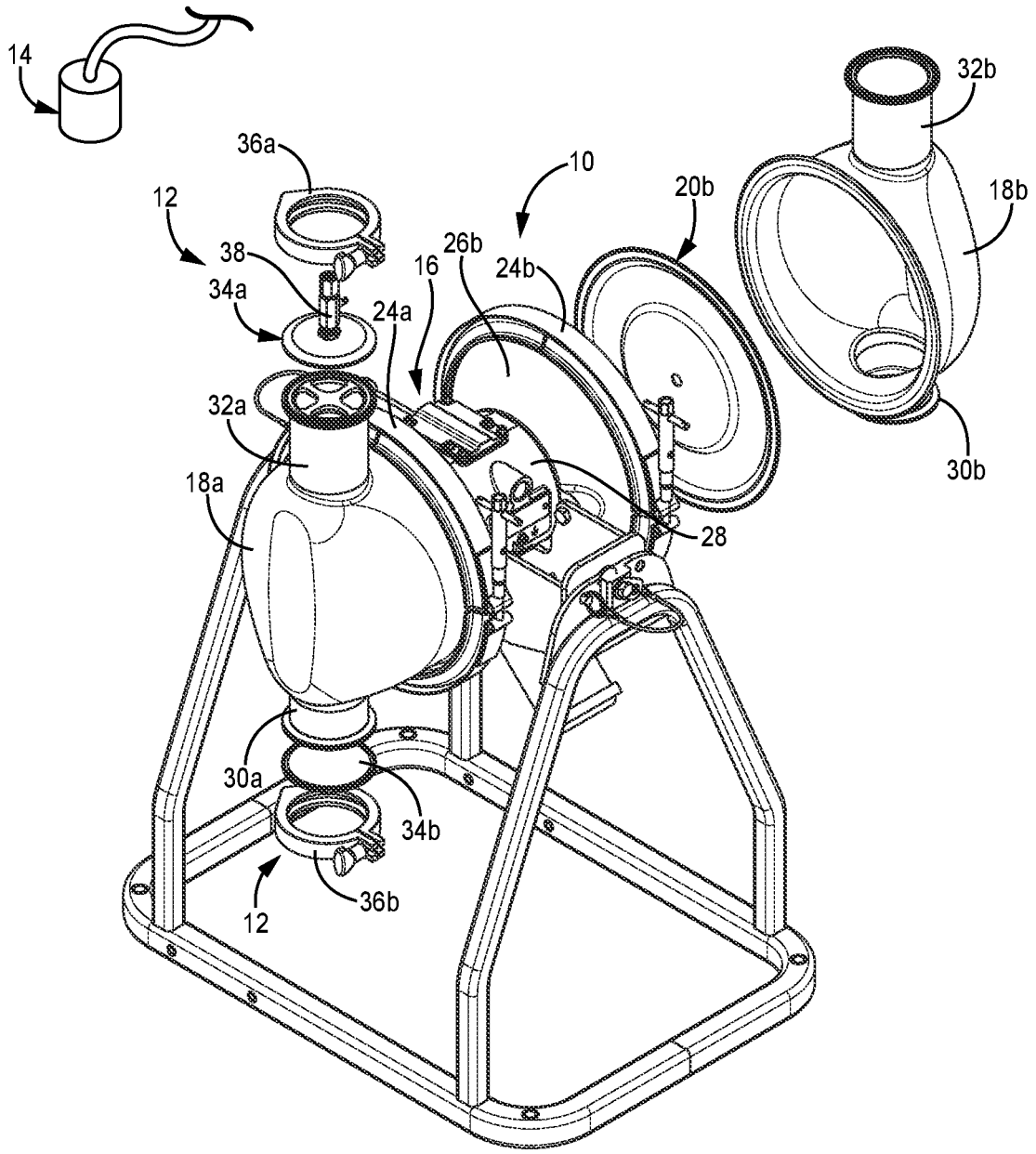
FIG. 1A is an isometric partially exploded view of a pump assembly.
Figure 1B:
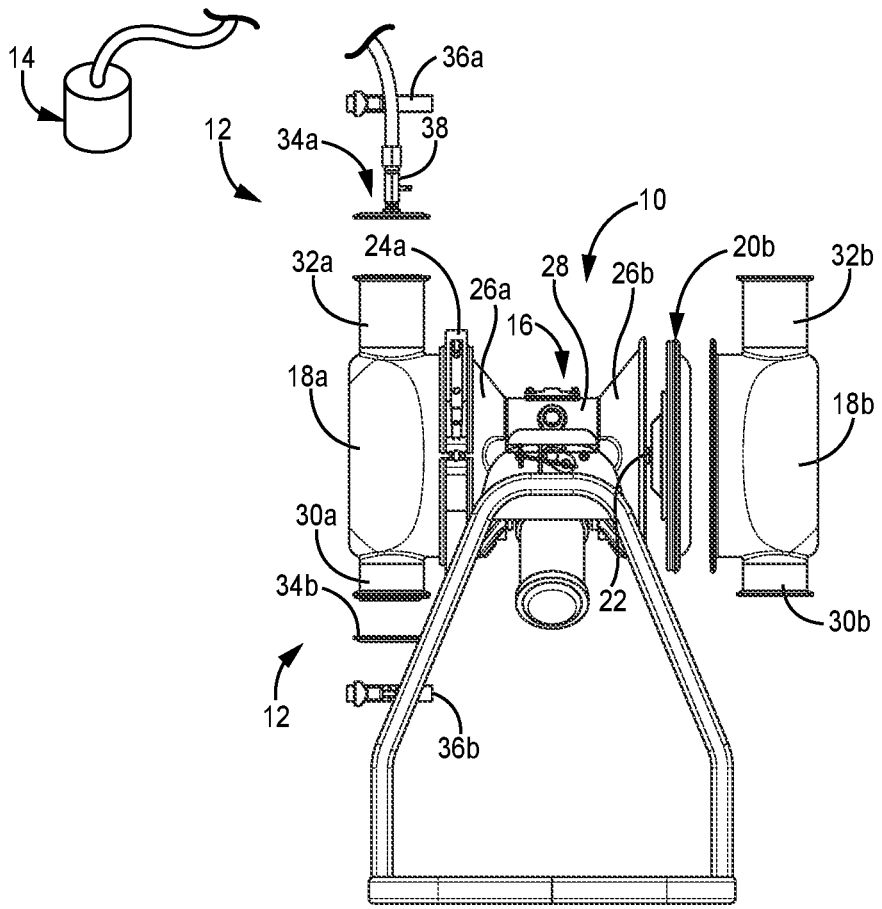
FIG. 1B is a side elevation partially exploded view of the pump assembly of FIG. 1A.

FIG. 1A is an isometric partially exploded view of pump assembly 10 and mounting kit 12. FIG. 1B is a side elevation partially exploded view of pump assembly 10 and mounting kit 12. FIGS. 1A and 1B will be discussed together. Vacuum source 14 is shown schematically in FIGS. 1A and 1B. Pump assembly 10 includes center section 16; covers 18*a*, 18*b*; diaphragms 20*a*, 20*b* (only diaphragm 20*b* shown in FIGS. 1A and 1B); shaft 22; and cover clamps 24*a*, 24*b*. Center section includes receivers 26*a*, 26*b* and center housing 28. Covers 18*a*, 18*b* respectively include inlet necks 30*a*, 30*b* and outlet necks 32*a*, 32*b*. Mounting kit 12 includes caps 34*a*, 34*b* and cap clamps 36*a*. 36*b*. Cap 34*a* includes fitting 38.

Pump assembly 10 includes two nearly identical sides that respectively include diaphragm 20*a* and diaphragm 20*b*. Each side includes a cover 18*a*, 18*b*, which covers 18*a*, 18*b* can also be referred to as housing covers. Covers 18*a*, 18*b* and diaphragms 20*a*, 20*b* define pumping chambers 40*a*, 40*b* (FIGS. 2A-2C) through which the process fluid is pumped by the pump assembly 10. Specifically, the process fluid is drawn from upstream through inlet necks 30*a*, 30*b* and driven downstream through outlet necks 32*a*, 32*b* by reciprocation of diaphragms 20*a*, 20*b*.

Diaphragm 20*a* is clamped between housing cover 18*a* and center section 16. Diaphragm 20*b* is similarly clamped between housing cover 18*b* and center section 16. More specifically, diaphragms 20*a*, 20*b* are clamped between housing covers 18*a*, 18*b* and receivers 26*a*, 26*b* of center section 16. Center section 16 can also be referred to as a body of the pump assembly 10. It is understood that receivers 26*a*, 26*b* can be formed separately from or integrally with a center housing 28 of center section 16. In the example shown, cover clamps 24*a*, 24*b* secure covers 18*a*, 18*b* to center section 16. It is understood, however, that covers 18*a*, 18*b* can be secured to center section 16 in any desired manner, such as by fasteners (e.g., bolts), among other options.

Inlet necks 30*a*, 30*b* allow pumped fluid to flow into pumping chambers 40*a*, 40*b*, respectively. In some examples, inlet necks 30*a*, 30*b* are connected to a common inlet manifold (not shown) such that each side of pump assembly 10 receives an inflow from a common upstream flow. Outlet necks 32*a*, 32*b* provide the pumped fluid downstream out of the pumping chambers 40*a*, 40*b*. In some examples, outlet necks 32*a*, 32*b* are connected to a common outlet manifold such that the flows from both sides of the pump assembly 10 combine downstream of the pumping chambers 40*a*, 40*b* to form a common downstream flow. Inlet checks can be disposed in the inlet necks 30*a*, 30*b* to prevent retrograde flow out of the pump assembly 10 through the inlet necks 30*a*, 30*b*. Outlet checks can be disposed in the outlet necks 32*a*, 32*b* to prevent retrograde flow into the pump assembly 10 through outlet necks 32*a*, 32*b*. For example, inlet checks and outlet checks can be formed as ball valves.

As shown in FIGS. 1A and 1B, during assembly of pump assembly 10 a first cover 18*a* is initially mounted to center section 16 to secure the first diaphragm 20*a* between cover 18*a* and center section 16. Cap 34*a* is mounted to a first one of the inlet neck 30*a* and the outlet neck 32*a* of the cover 18*a* that is first mounted to the center section 16. Cap 34*b* is mounted to a second one of the inlet neck 30*a* and outlet neck 32*a* that cover 18*a* is not mounted to. In the example shown, cap 34*a* is mounted to outlet neck 32*a* and cap 34*b* is mounted to inlet neck 30*a*. Mounting cap 34*a* to outlet neck 32*a* facilitates operation of the mounting kit 12 when the inlet checks and outlet checks are already installed on pump assembly 10.

Cap 34*a* seals outlet neck 32*a* to provide a fluid-tight seal at outlet neck 32. Cap 34*b* seals inlet neck 30 to provide a fluid-tight seal at inlet neck 30. In the example shown, caps 34*a*, 34*b* are secured to cover 18*a* by cap clamps 36*a*. 36*b*, respectively. While caps 34*a*, 34*b* are shown as mounted by way of cap clamps 36*a*. 36*b*, it is understood that caps 34*a*, 34*b* can be mounted and secured to cover 18*a* in any desired manner. For example, outlet neck 32*a* can include threading and cap 34*a* can be a threaded disk that threads into the threading of outlet neck 32*a*. Similarly, cap 34*b* can be a threaded disk that threads into the threading of inlet neck 30*a*.

While cap 34*b* is a plug that blocks and seals the inlet neck 30*a*, cap 34*a* includes one or more apertures for removing air from within cover 18*a* to develop a partial vacuum within the cover 18*a*. Cap 34*b* can be formed by a disk that plugs the neck that the cap 34*b* is mounted on to form an airtight seal and prevent flow through that neck. In some examples, cap 34*b* does not include any apertures through which air can flow. Fitting 38 is mounted to the disk forming cap 34*a* such that the only passage for flow from within cover 18*a* is through fitting 38. Also shown in FIG. 1A is vacuum source 14. Vacuum source 14 can be a pump (e.g., a compressor) that can develop a vacuum or a source of air which can cause air to exit from the pumping chamber 40*a* within the housing cover 18*a*. In some examples, fitting 38 can be configured to connect to a hose extending from vacuum source 14 and vacuum source 14 can be configured as a vacuum pump that draws air from the pumping chamber 40*a*. In other examples, fitting 38 can be a vacuum generator that itself draws air from the pumping chamber 40*a*, such as via the venturi effect and air flowing into and out of the fitting 38. In such an example, vacuum source 14 can that be an air compressor that drives compressed air to the fitting 38 to cause the vacuum generator formed by fitting 38 to draw the air out of the pumping chamber within cover 18*a*. In the case of a vacuum being generated by venturi effect, pressurized air flows through a first port on the fitting 38, passed an aperture that leads to a chamber within the housing cover 18, and out to a second port on the fitting 38. In each example discussed, a vacuum generator draws air from the pumping chamber 40*a* to reduce the pressure within that pumping chamber 40*a*. A partial vacuum is created in the pumping chamber 40*a* to draw diaphragm 20*a* in the first axial direction AD1, which draws diaphragm 20*b* in the first axial direction AD1 by the mechanical link between diaphragm 20*a* and diaphragm 20*b*.

The reduced pressure in the pumping chamber 40*a* draws diaphragm 20*a* in first axial direction AD1, drawing diaphragm 20*b* in the first axial direction AD1 due to the mechanical link between diaphragms 20*a*, 20*b* that is formed by shaft 22. Diaphragm 20*b* is drawn into a seated position on receiver 26*b*. The housing cover 18*b* can then be positioned on center section 16 to clamp the outer edge of diaphragm 20*b* between receiver 26*b* and housing cover 18*b*. Housing cover 18*b* is fixed to center section 16 to securely clamp the edge of the diaphragm 20*b* between housing cover 18*b* and receiver 26*b*. In the example shown, cover clamp 24*b* is secured on pump assembly 10 to fix housing cover 18*b* to center section 16. It is understood, however, that housing cover 18*b* can be fixed to center section 16 in any desired manner, such as by fasteners (e.g., bolts) extending through housing cover 18*b* into receiver 26*b* or through receiver 26*b* into housing cover 18*b*.

Mounting kit 12 provides significant advantages. Mounting kit 12 facilitates easy mounting of the second diaphragm, diaphragm 20*b* in the example discussed, by drawing air out of the already formed pumping chamber. Caps 34*a*, 34*b* are easily and quickly mounted to housing cover 18*a* and then air is drawn out of housing cover 18*a* to draw diaphragm 20*b* towards center section 16 for mounting due to the mechanical connection between diaphragms 20*a*, 20*b*. Mounting kit 12 does not require any disassembly of components of pump assembly 10 to route air or otherwise bias the diaphragm 20*a* to shift diaphragm 20*b*. Mounting kit 12 does not require large C-clamps or other mechanical components to try and bias and align the second diaphragm 20*b* for mounting. Mounting kit 12 facilitates easy mounting of the diaphragm 20*b*. Mounting kit 12 requires few components and can be quickly and easily applied to pump assembly 10 to mount the diaphragms. Pump assembly 10 can be placed in operation by simply removing mounting kit 12 after mounting the second diaphragm 20*b* and connecting inlet necks 30*a*, 30*b* to receive fluid from an upstream location and connecting outlet necks 32*a*, 32*b* to provide fluid to a downstream location. The user does not need to disassemble components of pump assembly 10, such as air routing components, that can be easily damaged or misplaced in order to route air to an interior chamber and bias diaphragm 20*a*. Instead, the mounting kit 12 is separate from the operating components of pump assembly 10 such that the interior components of pump assembly 10 can remain in an operational configuration throughout the mounting process.

Figure 2A:
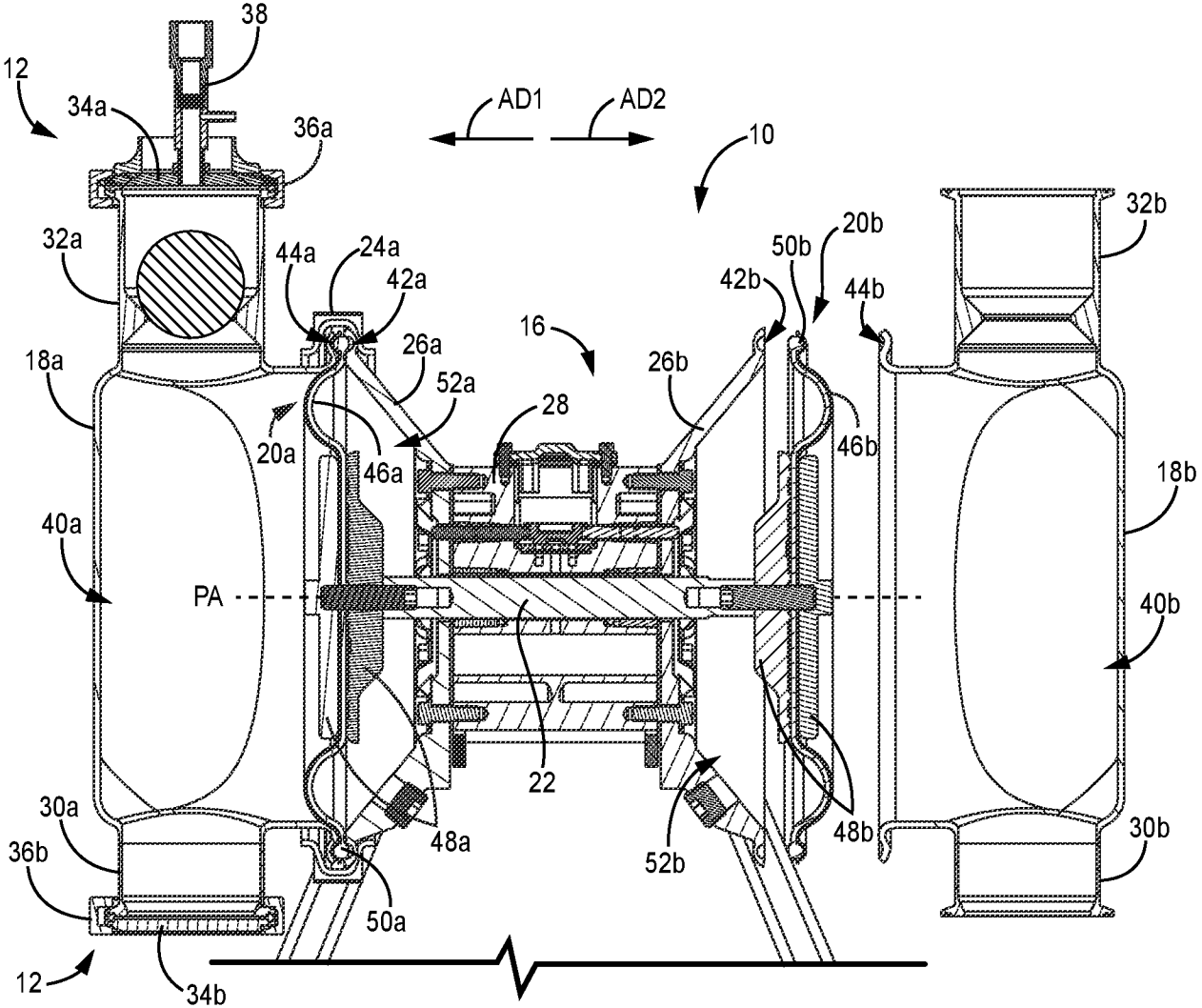
FIG. 2A is a cross-sectional view of the pump assembly of FIG. 1A in a first state.
Figure 2B:
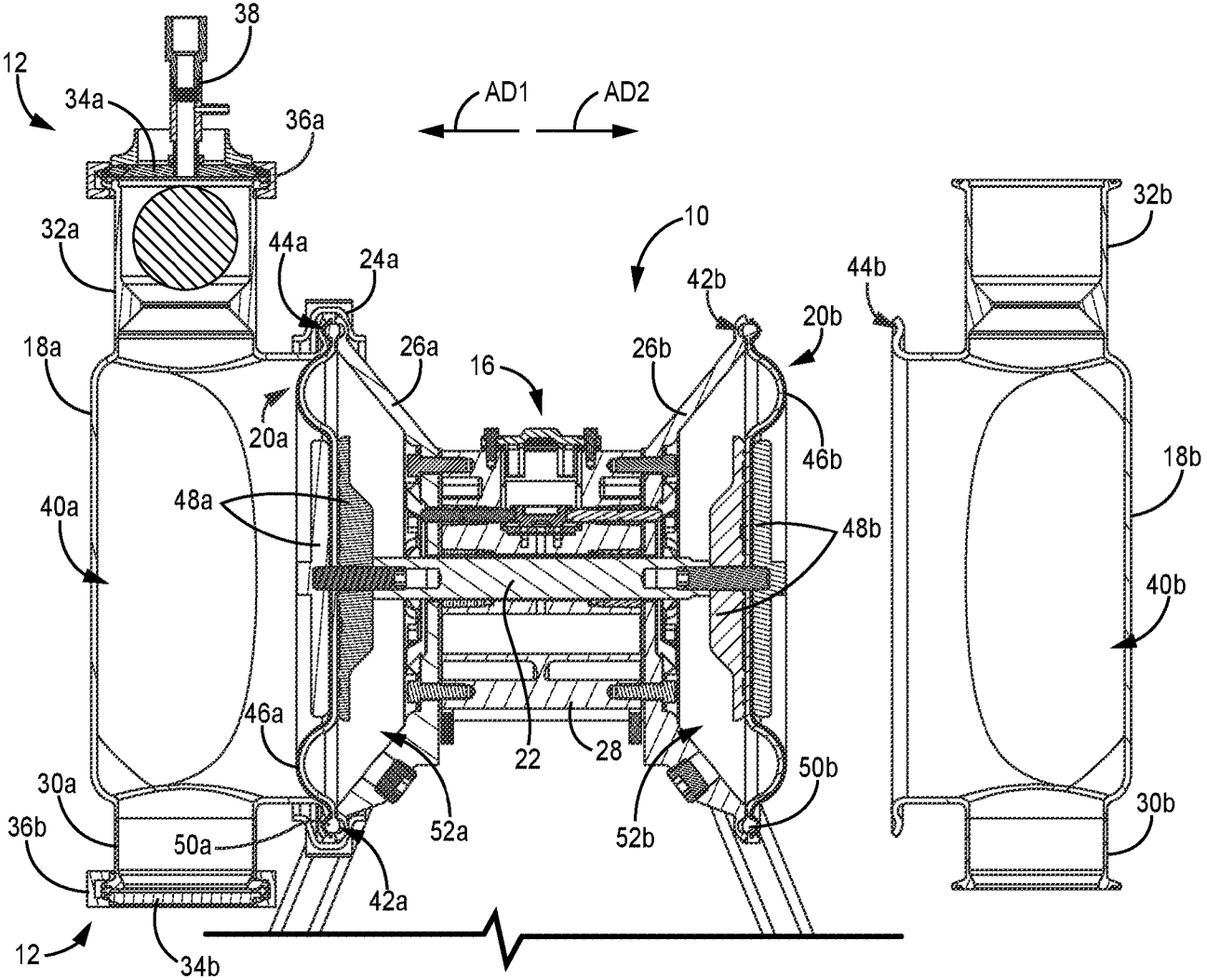
FIG. 2B is a cross-sectional view of the pump assembly of FIG. 2A in a second state.
Figure 2C:
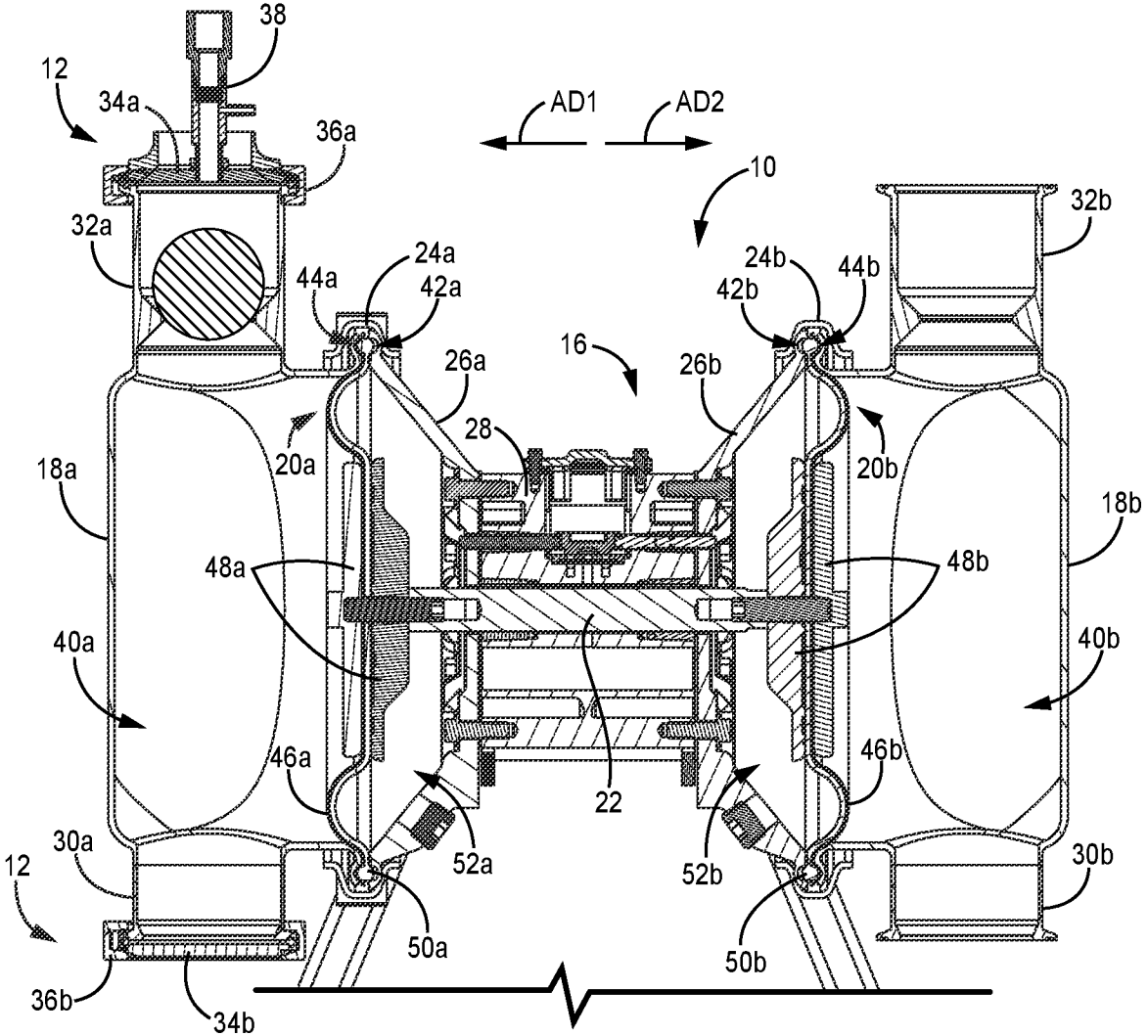
FIG. 2C is a cross-sectional view of the pump assembly of FIG. 2A in a third state.

FIG. 2A is a cross-sectional view of the pump assembly 10 of FIG. 1A in a first state. FIG. 2B is a cross-sectional view of the pump assembly 10 of FIG. 2A in a second state. FIG. 2C is a cross-sectional view of the pump assembly 10 of FIG. 2A in a third state. Pump assembly 10 includes center section 16; covers 18*a*, 18*b*; diaphragms 20*a*, 20*b*; and shaft 22. Receivers 26*a*, 26*b* and center housing 28 of center section 16 are shown. Covers 18*a*, 18*b* respectively include inlet necks 30*a*, 30*b* and outlet necks 32*a*, 32*b*. Receivers 26*a*, 26*b* respectively include receiver grooves 42*a*, 42*b*. Covers 18*a*, 18*b* respectively include cover grooves 44*a*, 44*b*. Diaphragm 20*a* includes membrane 46*a* and plates 48*a*. Bead 50*a* is formed at a circumferential edge of membrane 46*a*. Diaphragm 20*b* includes membrane 46*b* and plates 48*b*. Bead 50*b* is formed at a circumferential edge of membrane 46*b*. Mounting kit 12 is shown and includes caps 34*a*, 34*b* and cap clamps 36*a*. 36*b*. Cap 34*a* includes fitting 38.

Covers 18*a*, 18*b* are mounted to center section 16 to clamp diaphragms 20*a*, 20*b* between covers 18*a*, 18*b* and center section 16. Center section 16 includes receiver 26*a* on a first axial side of center housing 28 and receiver 26*b* on a second, opposite axial side of center housing 28. In the example shown, receivers 26*a*, 26*b* are mounted to center housing 28 by fasteners, though it is understood that pump assembly 10 can be formed in any desired manner, such as with receivers 26*a*, 26*b* integrally formed with center housing 28 or clamped to center housing 28.

Receiver grooves 42*a*, 42*b* are formed on receivers 26*a*, 26*b*, respectively. Cover grooves 44*a*, 44*b* are formed on covers 18*a*, 18*b*, respectively. Receiver groove 42*a* opposes cover groove 44*a* and bead 50*a* is clamped therebetween. Bead 50*a* is formed as an enlargement at the outer circumferential edge of diaphragm 20*a*. Bead 50*a* can be formed as a continuous bulge extending annularly about the outer edge of the membrane 46*a* or can be formed as a series of bulges disposed annularly about the outer edge of membrane 46*a*. Bead 50*a* is captured in receiver groove 42*a* and cover groove 44*a* to form a fluid tight seal therebetween.

Receiver groove 42*b* opposes cover groove 44*b* and bead 50*b* is clamped therebetween. Bead 50*b* is formed as an enlargement at the outer circumferential edge of diaphragm 20*b*. Bead 50*b* can be formed as a continuous bulge extending annularly about the outer edge of the membrane 46*b* or can be formed as a series of bulges disposed annularly about the outer edge of membrane 46*b*. Bead 50*b* is captured in receiver groove 42*b* and cover groove 44*b* to form a fluid tight seal therebetween.

Diaphragms 20*a*, 20*b* are connected to each other by shaft 22 extending therebetween. Shaft 22 can also be referred to as a connector as shaft 22 mechanically links diaphragm 20*a* and diaphragm 20*b*. Diaphragms 20*a*, 20*b* are connected to opposite ends of shaft 22 by fasteners extending into shaft 22. Shaft 22 extends through center housing 28 to connect to diaphragms 20*a*, 20*b*.

In the example shown, diaphragm 20*a* is formed by plates 48*a* disposed on opposite sides of membrane 46*a*. Membrane 46*a* extends radially outward from plates 48*a*, relative to a reciprocation axis of diaphragm 20*a* and is clamped between receiver 26*a* and cover 18*a*. In the example shown, diaphragm 20*b* is formed similar to diaphragm 20*a* and includes plates 48*b* disposed on opposite sides of membrane 46*b*. Membrane 46*b* extends radially outward from plates 48*b*, relative to a reciprocation axis of diaphragm 20*b*, and is clamped between receiver 26*b* and cover 18*b*. It is understood that diaphragm 20*b* can be configured differently from diaphragm 20*a* in other examples. In the example shown, diaphragms 20*a*, 20*b* are disposed coaxially on pump axis PA and are configured to reciprocate along pump axis PA during operation to pump the process fluid through pumping chambers 40*a*, 40*b*. As such, the reciprocation axes of diaphragms 20*a*, 20*b* are coaxial with the pump axis PA.

Pumping chamber 40*a* is formed within housing cover 18*a* and at least partially defined by diaphragm 20*a*. Process fluid is pumped through pumping chamber 40*a* by reciprocation of diaphragm 20*a*. The pumped material enters pumping chamber 40 through inlet neck 30*a* and exits pumping chamber 40*a* through outlet neck 32*a*. Check valves (not shown) are disposed in inlet neck 30*a* to prevent retrograde flow out of pumping chamber 40*a* and in outlet neck 32*a* to prevent retrograde flow into pumping chamber 40*a*. A ball of the outlet check of outlet neck 32*a* is shown in FIGS. 2A-2C. Air chamber 52*a* is disposed on an opposite side of diaphragm 20*a* from pumping chamber 40*a*. Air chamber 52*a* is formed within center section and, in the example shown, is at least partially defined by diaphragm 20*a* and receiver 26*a*. During operation, compressed air is provided to air chamber 52*a* to drive diaphragms 20*a*, 20*b* in the first axial direction AD1.

Pumping chamber 40*b* is formed within housing cover 18*b* and at least partially defined by diaphragm 20*b*. Process fluid is pumped through pumping chamber 40*b* by reciprocation of diaphragm 20*b*. The pumped material enters pumping chamber 40 through inlet neck 30*b* and exits pumping chamber 40*b* through outlet neck 32*b*. Check valves (not shown) are disposed in inlet neck 30*b* to prevent retrograde flow out of pumping chamber 40*b* and in outlet neck 32*b* to prevent retrograde flow into pumping chamber 40*b*. Air chamber 52*b* is disposed on an opposite side of diaphragm 20*b* from pumping chamber 40*b*. Air chamber 52*b* is formed within center section and, in the example shown, is at least partially defined by diaphragm 20*b* and receiver 26*b*. During operation, compressed air is provided to air chamber 52*b* to drive diaphragms 20*a*, 20*b* in the second axial direction AD2.

A valve, such as a shuttle assembly (not shown), is configured to alternatingly direct air to air chambers 52*a*, 52*b*. Compressed air is directed to air chamber 52*a* and vented from air chamber 52*b* to drive diaphragms 20*a*, 20*b* in first axial direction AD1. Compressed air is directed to air chamber 52*b* and vented from air chamber 52*a* to drive diaphragms 20*a*, 20*b* in second axial direction AD2.

During assembly, diaphragms 20*a*, 20*b* are connected to shaft 22, such as by fasteners that thread into shaft 22. Diaphragm 20*a* is positioned such that bead 50*a* is disposed in receiver groove 42*a*. Cover 18*a* is connected to receiver 26*a* such that bead 50*a* is captured within receiver groove 42*a* and cover groove 44*a*. Cover 18*a* is fixed to receiver 26*a*, by cover clamp 24*a* in the example shown. The first diaphragm mounted, which is diaphragm 20*a* in the example discussed, can typically be installed without any specialized tools. Diaphragm 20*a* naturally wants to assume a non-flexed state, which biases diaphragm 20*b* in second axial direction AD2 and away from receiver 26*b*.

In the first state shown in FIG. 2A, cover 18*a* is fixed to receiver 26*a* and diaphragm 20*a* is clamped between cover 18*a* and receiver 26*a*. Diaphragm 20*b* is spaced from receiver 26*b* and needs to be shifted in first axial direction AD1 for mounting. Mounting kit 12 is assembled on pump assembly 10 and operated to place diaphragm 20*b* in a desired position for mounting.

Cap 34*a* is mounted to outlet neck 32*a* in the example shown. Mounting cap 34*a* to outlet neck 32*a* allows the mounting procedure to proceed even when the check valves are already assembled to inlet neck 30*a* and outlet neck 32*a*. The inlet check valve is removed from inlet neck 30*a* if cap 34*a* is mounted to inlet neck 30*a*.

The disk of cap 34*a* is sealingly mounted to outlet neck 32*a* such that air can flow out of pumping chamber 40*a* only through cap 34*a*, and specifically through fitting 38 mounted to the disk of cap 34*a*. In the example shown, cap 34*a* is secured to outlet neck 32*a* by cap clamp 36*a*. As discussed above, while cap 34*a* is shown as clamped to cover 18*a*, cap 34*a* can be secured to cover 18*a* in any desired manner, such as by interfaced threading, among other options. Fitting 38 projects from cap 34*a* and is fluidly connected to the pumping chamber 40*a* within cover 18*a*.

Cap 34*b* is mounted to the opposite one of inlet neck 30*a* and outlet neck 32*a* from cap 34*a*. In the example shown, cap 34*b* is mounted to inlet neck 30*a*. The disk of cap 34*b* is sealingly mounted to inlet neck 30*a*. In the example shown, cap 34*b* is secured to inlet neck 30*a* by cap clamp 36*b*. As discussed above, while cap 34*b* is shown as clamped to cover 18*a*, cap 34*b* can be secured to cover 18*a* in any desired manner, such as by interfaced threading, among other options. With cap 34*b* mounted to inlet neck 30*a* and cap 34*a* mounted to outlet neck 32*a*, pumping chamber 40*a* is a sealed cavity and air can exit only through fitting 38 of cap 34*a*.

A vacuum source, such as vacuum source 14 (FIG. 1A), is connected to mounting kit 12 at fitting 38. For example, a hose that extends from the vacuum source can be connected to fitting 38. The vacuum source is powered, causing air to be drawn out of pumping chamber 40*a* through fitting 38. Drawing air out of the pumping chamber 40*a* lowers the pressure within the pumping chamber 40*a*, which reduced pressure pulls the diaphragm 20*a* in the first axial direction AD1. Pulling the diaphragm 20*a* in the first axial direction also pulls shaft 22 in the first axial direction AD1 due to the fixation of diaphragm 20*a* to shaft 22. Shaft 22 is also fixed to diaphragm 20*b* such that pulling diaphragm 20*a* in the first axial direction AD1 also pulls diaphragm 20*b* in the first axial direction AD1. Diaphragm 20*b* displaces in the first axial direction AD1 and is pulled against the receiver 26*b*.

The displacement flexes both of the diaphragms 20*a*, 20*b*, overcoming any resisting elastic forces and allowing the bead 50*b* of the diaphragm 20*b* to press against the receiver 26*b* and seat within receiver groove 42*b*. Such displacement places the pump assembly 10 in the second state shown in FIG. 2B.

With pump assembly 10*b* in the state shown in FIG. 2B, the housing cover 18*b* can be placed against the diaphragm 20*b* and secured to receiver 26*b*. Once the diaphragm 20*b* is in place, the housing cover 18*b* can be mounted on the center housing 28. In the example shown, housing cover 18*b* is mounted by clamping with cover clamp 24*b*. The bead 50*b* of diaphragm 20*b* is clamped within receiver groove 42*b* and cover groove 44*b* to mount and seal the diaphragm 20*b*. Pump assembly 10 is thus placed in the third, assembled state shown in FIG. 2C. Mounting kit 12 can be removed from cover 18*a* and inlet and outlet manifolds can be mounted to covers 18*a*, 18*b* to connect pump assembly 10 within a pumping system. The vacuum source can be deactivated and the pumping chamber 40*a* can be returned to atmospheric pressure after the second diaphragm 20*b* is mounted.

Use of the vacuum mounting kit 12 facilitates easy mounting and sealing of a diaphragm without operating the pump assembly 10 with pneumatic or other type of power, other than that provided by the vacuum source. As such, only the pumping chamber 40*a* is at a pressure other than atmospheric, while the normally pneumatically pressurized air chambers 52*a*, 52*b* within the center section 16 are not pressurized. Without the mounting kit 12, the diaphragm 20*b* must be moved into place by hand to overcome the elastic force generated by the diaphragm 20*a* which can be difficult to keep in place while attempting to finalize the seal in securing the cover 18*b* to the center section 16 with cover clamp 24*b*. Diaphragm 20*b* could also be moved into place by disassembling delicate components of pump assembly 10, installing air directing components within the pump assembly 10 to pressurize only the air chamber 52*a*, uninstalling those directing components, and reassembling the delicate air directing components of pump assembly 10, which risks damage to those delicate components of pump assembly 10 and, because the components are removed, creates a risk of misplacing of losing components of pump assembly 10. Disassembly is also time consuming and requires a skilled operator to ensure that components are reassembled correctly to operate the pump.

The reduced pressure in pumping chamber 40*a* provides a quick and efficient way to position diaphragm 20*b* at a desired location to facilitate assembly and mounting of housing cover 18. The pump assembly 10 can quickly be placed into operation after assembling housing cover 18 to center section 16 without requiring disassembly and reassembly of other components of pump assembly 10. In addition, a single mounting kit 12 can be configured for use on different pump assemblies having different configurations. Mounting kit 12 thereby provides an efficient and effective system for mounting diaphragms across a wide array of diaphragm pump configurations.

Figure 3A:
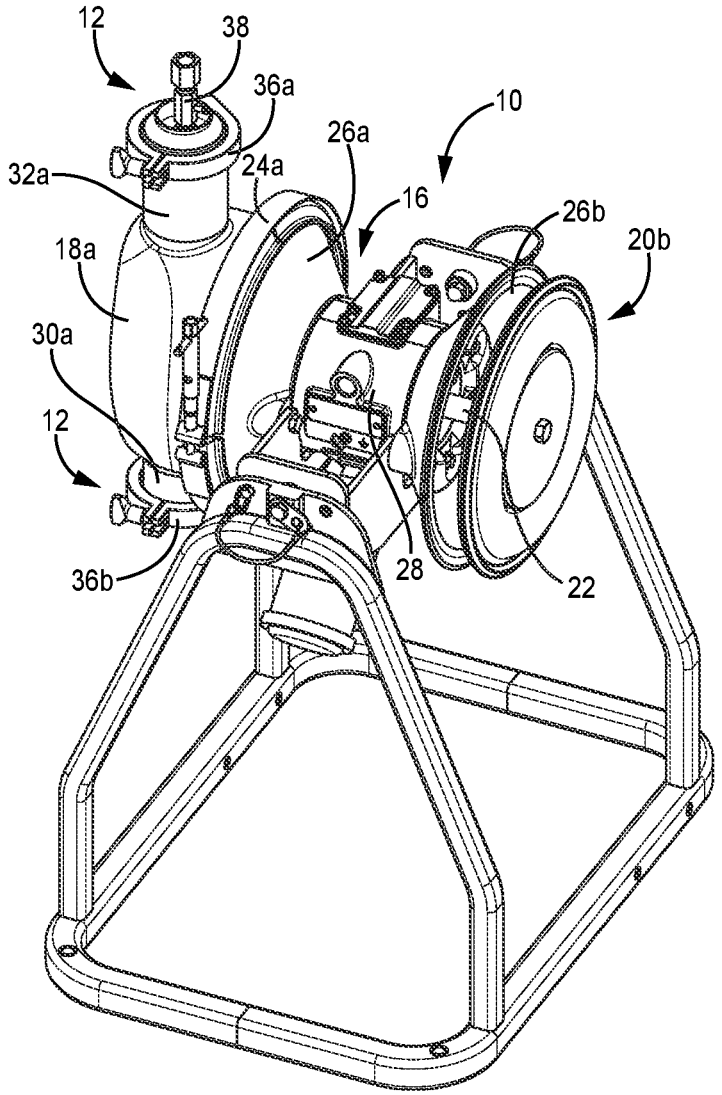
FIG. 3A is an isometric view of the pump assembly of FIG. 2A in the first state.
Figure 3B:
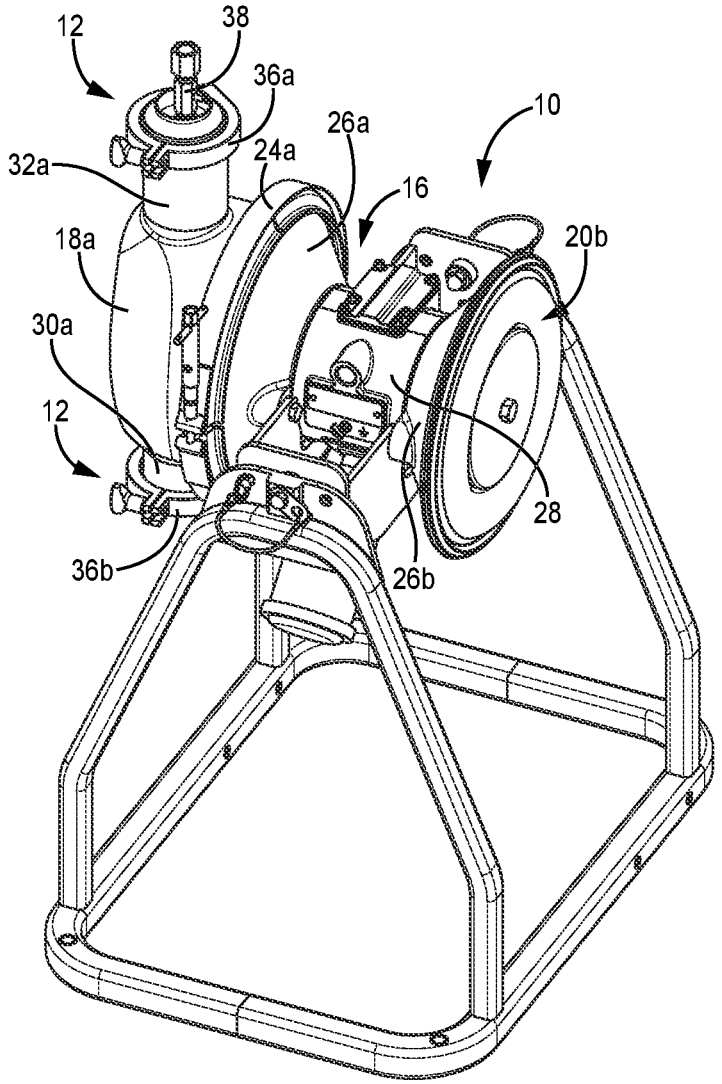
FIG. 3B is an isometric view of the pump assembly of FIG. 2A in the third state.

FIG. 3A is an isometric view of pump assembly 10 in the first state shown in FIG. 2A. FIG. 3B is an isometric view of pump assembly 10 in the second state shown in FIG. 2B. FIGS. 3A and 3B will be discussed together. As shown in FIG. 3A, diaphragm 20*b* is initially spaced from receiver 26*b* and must be shifted towards receiver 26*b* to seal against and mount to receiver 26*b*. Mounting kit 12 is assembled to pump assembly 10. Specifically, mounting kit 12 is mounted to cover 18*a* that is assembled to center section 16. A vacuum source, which can be a vacuum pump, source of compressed air, or other component configured to draw air from the pumping chamber, is connected to fitting 38, such as by a hose. The vacuum source can draw the air directly from the pumping chamber, in examples where the vacuum source is a vacuum pump, or can provide a flow of compressed air to fitting 38 and fitting 38 can be configured as a vacuum generator that draws the air from the pumping chamber. For example, fitting 38 can draw the air from the pumping chamber by the venturi effect in response to the compressed air flowing to the fitting 38.

Air is drawn out of the pumping chamber 40*a* (shown in FIGS. 2A-2C) through fitting 38. The reduced pressure in the pumping chamber causes the diaphragm 20*a* (shown in FIGS. 2A-2C) to shift in first axial direction AD1, which draws diaphragm 20*b* in first axial direction AD1 due to the mechanical connection between the diaphragms 20*a*, 20*b*, which mechanical connection is formed by shaft 22. Diaphragm 20*b* shifts to the mounting position on receiver 26*b*, as shown in FIG. 3B. In the state shown in FIG. 3B, the reduced pressure continues to be generated inside of the cover 18*a*. The reduced pressure maintains the diaphragm 20*b* in the desired position on receiver 26*b* for mounting of the cover 18*b* (shown in FIGS. 1A-2C) and clamping of diaphragm 20*b* between cover 18*b* and receiver 26*b*. The reduced pressure maintaining the diaphragm 20*b* in the desired mounting position allows the user to fix cover 18*b* on the center section 16 without concern about the diaphragm 20*b* unseating or being misaligned. The cover 18*b* can be mounted in any desired manner, such as by a clamp (e.g., cover clamp 24*b* (best seen in FIG. 1B)) or fasteners (e.g., bolts), among other options. After mounting cover 18*b*, diaphragm 20*b* is secured for pumping. The vacuum source can be deactivated and mounting kit 12 removed from cover 18*a*. Pump assembly 10 is then ready for connection to an upstream fluid source and downstream fluid destination for pumping operation.

Mounting kit 12 and the method of mounting the diaphragms to assemble pump assembly 10 provides significant advantages. Mounting kit 12 can be assembled to pump assembly 10 and removed from pump assembly 10 without requiring disassembly of other components of pump assembly 10. Mounting kit 12 thereby reduces the time required to mount both diaphragms 20*a*, 20*b* to pump assembly 10. Reducing the pressure within the cover 18*a* draws the opposite diaphragm 20*b* into a seated position and maintains the diaphragm 20*b* in the seated position while the user assembles cover 18*b* to center section 16*b*. Such a configuration provides a simple mounting procedure that requires less time and effort than physically pushing and holding the diaphragm 20*b* into the seating position or charging an air chamber.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of mounting diaphragms to a pump, the method comprising:

reducing a pressure in a first pumping chamber defined by a first diaphragm and a first cover, the first cover mounted to a center section of the pump such that the first diaphragm is clamped between the first cover and the center section;

drawing the first diaphragm in a first direction into the first pumping chamber by the reduced pressure to draw a second diaphragm linked to the first diaphragm in the first direction and place the second diaphragm in a mounting position relative to the center section; and mounting a second cover to the center section such that the second diaphragm is clamped between the second cover and the center section.

2. The method of claim 1, wherein reducing the pressure in the first pumping chamber defined by the first diaphragm and the first cover comprises:

connecting a first cap to a first neck of the first cover to seal the first neck;

connecting a second cap to a second neck of the first cover; and drawing air out of the first pumping chamber through the second cap to reduce the pressure in the first pumping chamber.

3. The method of claim 2, wherein reducing the pressure in the first pumping chamber defined by the first diaphragm and the first cover further comprises:

connecting a vacuum source to a fitting of the first cap, the vacuum source configured to cause the air to be drawn out of the first pumping chamber through the first cap.

4. The method of claim 3, wherein reducing the pressure in the first pumping chamber defined by the first diaphragm and the first cover further comprises:

providing a flow of compressed air to the fitting from the vacuum source; and drawing the air out of the first pumping chamber by the fitting in response to the flow of compressed air.

5. The method of claim 2, wherein connecting the first cap to the first neck of the first cover comprises:

clamping the first cap to the first neck.

6. The method of claim 2, wherein connecting the second cap to the second neck of the first cover comprises:

clamping the second cap to the second neck.

7. The method of claim 1, wherein reducing the pressure in the first pumping chamber defined by the first diaphragm and the first cover comprises:

plugging a first neck of the first cover to prevent airflow through the first neck; and drawing air out of the first cover through a second neck of the first cover to reduce the pressure in the first pumping chamber.

8. The method of claim 7, wherein plugging the first neck of the first cover to prevent airflow through the first neck comprises:

fixing a cap to an inlet neck of the first cover to plug the inlet neck, the inlet neck forming the first neck.

9. The method of claim 7, wherein drawing the air out of the first cover through the second neck of the first cover to reduce the pressure in the first pumping chamber comprises:

drawing the air out of the first pumping chamber through a fitting supported by a cap fixed to an outlet neck of the first cover, the outlet neck forming the second neck.

10. The method of claim 1, wherein drawing the first diaphragm in the first direction into the first pumping chamber by the reduced pressure to draw the second diaphragm linked to the first diaphragm in the first direction and place the second diaphragm in the mounting position relative to the center section comprises:

positioning the second diaphragm such that a bead of the second diaphragm is aligned with a receiver groove of a receiver of the center section.

11. The method of claim 10, wherein mounting the second cover to the center section such that the second diaphragm is clamped between the second cover and the center section further comprises:

positioning the second cover relative to the center section such that the bead of the second diaphragm is disposed within the receiver groove and a cover groove of the second cover.

12. The method of claim 1, further comprising:

returning the first pumping chamber to atmospheric pressure after the second diaphragm is mounted.

13. The method of claim 1, wherein mounting the second cover to the center section such that the second diaphragm is clamped between the second cover and the center section comprises:

securing the second cover to the center section by a cover clamp.

* * * * *